US005083685A

United States Patent [19]

Amemiya et al.

[11] Patent Number: 5,083,685

[45] Date of Patent: Jan. 28, 1992

[54] VESSEL FOR AEROSOL

[75] Inventors: Hideo Amemiya, Yokohama; Minoru Kuroda, Urawa; Tomio Nitta, Yokohama, all of Japan

[73] Assignees: Mitsui Toatsu Chemicals, Inc., Tokyo; Kabushiki Gaisha Tokai, Kanagawa, both of Japan

[21] Appl. No.: 544,935

[22] Filed: Jun. 28, 1990

[51] Int. Cl.[5] ..... B65D 83/38

[52] U.S. Cl. ..... 222/402.1; 222/402.24; 428/35.7

[58] Field of Search ..... 222/394, 402.1, 402.24; 428/35.7

[56] References Cited

U.S. PATENT DOCUMENTS

| | | | |
|---|---|---|---|
| 3,851,658 | 12/1974 | Bunyard | 137/102 |
| 4,350,272 | 9/1982 | Petterson | 222/389 X |
| 4,513,889 | 4/1985 | Beard | 222/402.1 X |
| 4,762,254 | 8/1988 | Nitta | 222/402.24 |

FOREIGN PATENT DOCUMENTS

| | | | |
|---|---|---|---|
| 0133770 | 7/1984 | European Pat. Off. | 222/402.1 |
| 3808438 | 4/1989 | Fed. Rep. of Germany | 222/402.1 |
| 1365298 | 8/1974 | United Kingdom | 222/394 |

*Primary Examiner*—Michael S. Huppert
*Assistant Examiner*—Joseph A. Kaufman
*Attorney, Agent, or Firm*—Burns, Doane, Swecker & Mathis

[57] ABSTRACT

A vessel according to the invention has a double-layer structure in which a vessel wall is constructed by an inner layer made of a special high-nitryl resin having excellent chemical resistance, gas barrier property, and the like and an outer layer made of a synthetic resin having excellent heat resistance, shock resistance, and the like. The vessel is suitable for use as a vessel for aerosol.

4 Claims, 1 Drawing Sheet

VESSEL FOR AEROSOL

TECHNICAL FIELD

The present invention relates to a vessel for aerosol made of a synthetic resin and, more particularly, to a vessel for aerosol made of a synthetic resin having excellent pressure resistance, heat resistance, and chemical resistance etc.

BACKGROUND OF THE INVENTION

Hitherto, a vessel for aerosol is made of a metal such as tinplate, aluminum, or the like. In recent years, the vessels for aerosol made of a synthetic resin have been used and a synthetic resin of the polyesters or polyacrylonitriles is used as a raw material.

Since the ultrasonic melt-bonding property of a vessel made of polyester is poor, a vessel in which a cap member made of metal which is attached to an opening portion of the vessel is mainly used.

On the other hand, since the high-nitryl resin has an excellent ultrasonic melt-bonding property, gas tightness, chemical resistance, and the like, high-nitrogen resin can be preferably used for vessels for aerosol and a pressure vessel which is suitable for an actual use may be obtained.

In such a conventional vessel for aerosol made of a synthetic resin, although there is no practical problem, it is desirable that the vessel has pressure resistance even at high temperatures of 60 to 70° C. or higher for the purpose of safety. In particular, in the case where the vessel main body is enlarged and the content is increased, in order to assure a necessary pressure resistance, it is effective to make the thickness of the vessel thick or to provide a partition wall within the vessel.

However, there are problems such that when the thickness of vessel is made thick or a partition wall is provided within the vessel, the inner volume is small as compared with the outside appearance and the vessel cannot be filled with a large quantity as compared with the metal vessel.

DISCLOSURE OF THE INVENTION

The present inventors have studied to solve the above problems; they have discovered that it is possible to obtain a vessel for aerosol whose inner volume is as large as possible and which has excellent pressure resistance, heat resistance, chemical resistance, and the like according to the present invention.

That is, the invention provides a vessel for aerosol in which a vessel main body made of synthetic resin and a cap member made of a synthetic resin are airtightly integratedly formed in an opening portion of the vessel main body, wherein the vessel main body has a double-layer structure and both an inner layer of the vessel main body and a spray valve assembly are made of a high-nitryl resin.

The high-nitryl resin which is used in the present invention is a copolymer mainly containing an unsaturated nitryl compound such as acrylonitrile, methacrylonitrile, or the like and containing 50 weight % or more, preferably, 55 weight % or more of an unsaturated nitryl compound unit.

As a comonomer, an unsaturated compound which is copolymerizable with the nitryl compound can be used. For instance, an unsaturated aromatic compound, a diene compound, an unsaturated ester, an unsaturated ether compound, or the like can be utilized. More specifically speaking, styrene, α-methylstyrene, butadiene, isoprene, methylacrylate, ethylacrylate, methylmethacrylate, ethylmethacrylate, and the like can be utilized. At least one kind of the above may be copolymerized with an unsaturated nitryl compound.

On the other hand, as a high-nitryl resin, there can be mentioned a resin in which a rubber-like copolymer such as a butadiene-acrylonitrile copolymer, a butadiene-styrene copolymer, an isoprene-styrene copolymer, polybutadiene, polylsoprene, or the like was mixed to the above-mentioned copolymer in such a manner that an unsaturated nitryl unit is set to 50 weight % or more. Particularly, there can be also mentioned a resin in which a mixture of an unsaturated nitryl compound and the above-mentioned comonomer was copolymerized under the existence of those rubber-like copolymers. The above high-nitryl resins are preferable because of the shock resistance.

Further, as a high-nitryl resin, a copolymer of an unsaturated nitryl compound with the above comonomer is used as a matrix and it is also possible to use a mixture of such a matrix and the foregoing rubber-like copolymer having a grafted portion of composition similar to such a matrix or a grafted portion which is soluble to such a matrix.

On the other hand, as a particularly desirable resin, there can be used a polymer in which a monomer mixture of 60 to 90 weight parts comprising an unsaturated nitryl compound of at least 60 weight % and an aromatic vinyl compound of at least 5 weight % was graft polymerized with diene synthetic rubbers of 1 to 40 weight parts containing a conjugated diene monomer of 50 weight % or more, wherein in the above polymer, when it is assumed that a content of the unsaturated nitryl compound in the resin grafted to the rubbers is set to X weight % and a content of the unsaturated nitryl compound in the matrix resin is set to Y weight %, the following formula is satisfied between X and Y.

$$60 < X \leqq Y < 90$$

Generally, since the high-nitryl resin has a high environmental stress crack resistance, it is suitable for use in vessels for aerosol or the like which are subject to a stress by an internal pressure and is widely used. However, the above-mentioned special high-nitryl resin has an especially high environmental stress crack resistance and is suitable for such use.

That is, a critical strain of the high-nitryl resin to ethanol which is used in vessels for cosmetics which have widely been used is about 0.4 to 1% as a value measured by a well-known Bergen's ¼ ellipse law. However, in the case of the above special high-nitryl resin, the critical strain of the high value of 0.65% or more is obtained.

Therefore, vessels for aerosol having a further excellent durability can be obtained by using the above resins and the vessel thickness can be made thiner.

An oxidation inhibitor, an ultraviolet absorbent, an antistatic agent, a lubricant, a filler agent of minerals, a color pigment, or the like, or a small quantity of other resins may be also contained in the above-mentioned high nitryl resins.

As a method of manufacturing the vessel main body of the double structure of the present invention, there can be used methods such as multilayer blow molding, multilayer injection-blow molding, multilayer injection molding, and the like. It is possible to mold and manufacture not only a cylindrical vessel but also vessels having the various cross sectional shapes of an ellipse, a rectangle, and the like. From a viewpoint of moldability, a method in which after the inner layer was injection molded, the outer layer is injection molded to thereby obtain a double-layer molded article, for instance, a double injection molding method is suitable. On the other hand, in order to increase an innerlayer adhesive property, an adhesive layer may be also provided between the outer and inner layers.

A synthetic resin for forming the outer layer of the vessel main body is not particularly limited. However, it is preferable to use a synthetic resin having excellent heat resistance, shock resistance etc. As such synthetic resins, there can be mentioned polypropylene, acrylonitrile-styrene copolymer, acrylonitrile-styrene-butadiene copolymer, high-impuct polystyrene, nylon, polyacetal, polycarbonate and the like.

An inorganic filler of minerals such as calcium carbonate, talc, barium sulfate, or the like, glass fibers, carbon fibers, and the like may be also contained in those resins.

The cap member portion of the vessel of the invention is made of a high-nitryl resin. A vessel airtightly integrated may be obtained by melting and bonding the cap member and the inner layer portion of the vessel main body made of the high-nitryl resin to each other. As a method of melting and bonding the cap member and the container main body to each other, an ultrasonic melt-bonding method, a high frequency melt-bonding method, a spin welding method, and the like can be utilized.

The vessels according to the present invention are useful as vessels for aerosol for storing a solution containing a solvent such as water, ethanol or the like for cosmetics, toiletry supplies, medicines, automobile supplies, industrial supplies, insecticide, germicide, antiphlogistic, hair conditioning agent, cleaners, and the like.

Further, the above vessels are also suitable to store acid and alkaline solutions which could not be used in metal cans hitherto. The above vessels can be used to store a liquid of a pH value within a range from 2 to 13.

BRIEF DESCRIPTION OF THE DRAWING

The drawing is a cross sectional view showing an embodiment of a vessel for aerosol according to the present invention.

PREFERRED EMBODIMENTS OF THE INVENTION

Figure 1:
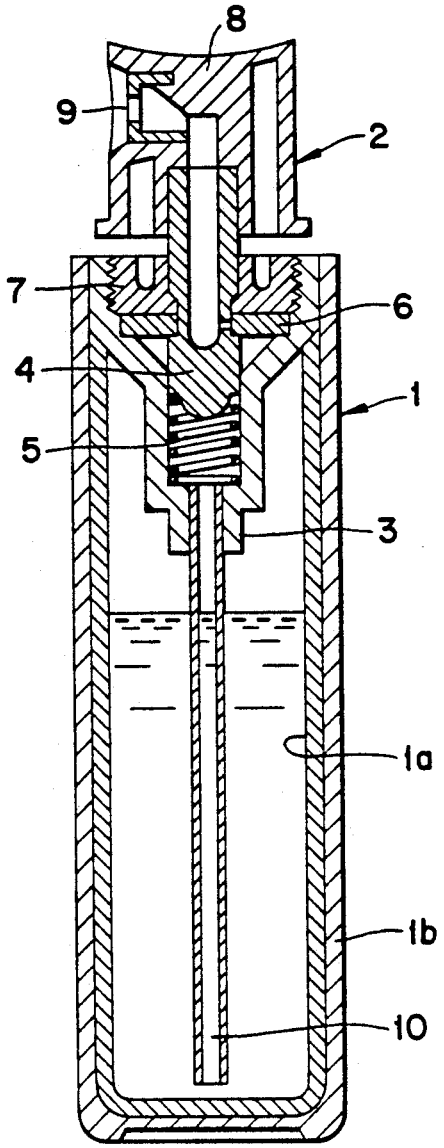
Figure 2:
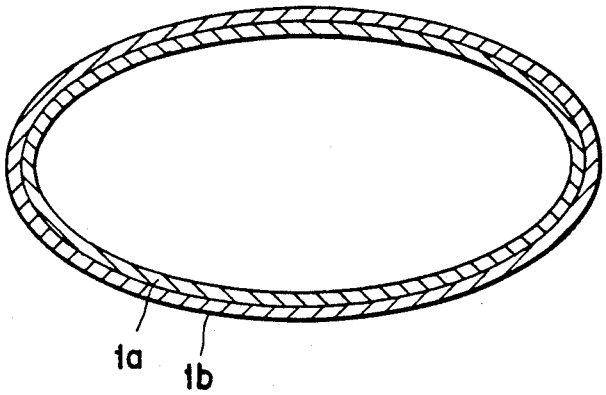
Figure 3:
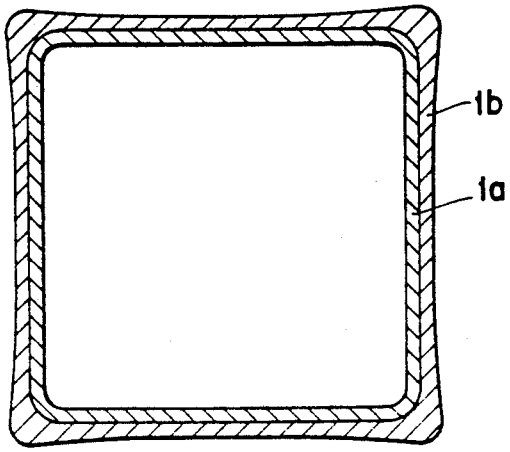

An embodiment of a vessel for aerosol according to the present invention will be described hereinbelow with reference to the drawing.

FIG. 1 is a schematic cross sectional view of the vessel for aerosol of the invention. The vessel main body comprises an outer layer 1*b* and an inner layer 1*a*. The vessel is formed by melt-bonding the inner layer 1*a* and a cap member 2 to each other and then airtightly integrating them.

Although an ordinary spray apparatus and parts such as a dip tube to suck up a content liquid and the like are assembled within the cap member 2, since they are not essential in the present invention, they are omitted in FIG. 1.

In FIG. 1, reference numeral 1 denotes a vessel and 2 indicates an spray valve assembly. The spray valve assembly 2 comprises: a housing 3; a valve 4; a spring 5; a packing 6: a sealing member 7; a pushing button 8; a nozzle 9; and a tube 10.

In the present invention, the vessel main body 1 is formed as a double structure comprising an inner layer 1*a* and an outer layer 1*b*. The inner layer 1*a* and the housing 3, are manufactured by using a high-nitryl resin excellent in chemical resistance and gas barrier property, thereby preventing the content from being transmitted from the wall of the vessel 1 and thereby being reduced in quantity. On the other hand, the performances such as heat resistance, shock resistance, and the like of the vessel which cannot be assured by a high-nitryl resin only may be assured by the outer layer 1*b* of the vessel main body being made of a resin having excellent heat resistance, shock resistance, and the like.

Although thicknesses of the outer layer 1*b* and inner layer 1*a* are not particularly limited, from viewpoints of the property of the resin, processability, easiness of the melt-bonding process, and the like, a thickness of the melt-bonding process, and the like, a thickness of the outer layer 1*b* is set to a value within a range from 0.5 to 2.5 mm, preferably 0.8 to 1.5 mm, and a thickness of the inner layer is set to a value within a range from 0.5 to 2 mm, preferably, 0.8 to 1.5 mm.

The invention will now be described hereinbelow with respect to examples.

EXAMPLE 1

Monomer compositions of 100 weight parts comprising acrylonitrile of 75 weight parts and methyl acrylate of 25 weight parts were polymerized under the existence of a butadiene-acrylonitrile rubber-like copolymer (butadiene of 70 weight %) of 10 weight parts, so that a high-nitryl resin (content ratio of acrylonitrile by a nitrogen analysis is set to 70 weight %) was obtained.

By use of the above high-nitryl resin and Amiran CM3, 001N (made by Toray Industries, Ltd.) as Nylon 66, a vessel main body whose inner layer is made of the high-nitryl resin and whose outer layer is made of nylon was obtained by an injection molding apparatus for molding a double-layer, said apparatus being made by a machine of Nissei Resin Industries, Ltd.

The vessel obtained, in the central portion of the vessel, a width was about 3.5 cm, a thickness was about 3 cm, a cross section was of a rectangular shape, a height was about 10 cm, and an inner volume was about 75 cc. On the other hand, a thickness of the outer layer was set to about 1.2 mm and a thickness of the inner layer was set to about 1 mm.

On the other hand, a cap member was obtained by injection molding by using the above high nitryl resin.

A mixture in which the water and ethanol had been mixed by each 50 weight % was poured into the vessel main body. The cap member to which the parts of the spray apparatus had been assembled was melted and bonded and sealed to the vessel main body by an ultrasonic welding while maintaining an inner pressure of 3.5 $kg/cm^2$ with mixture gases of freon 11 and freon 12.

Ten vessels were prepared as mentioned above and left at 65° C. for 24 hours and the presence or absence of deformation was examined. However, no deformation was found in any of the vessels.

On the other hand, ten other vessels were also similarly manufactured. With respect to those ten vessels, the drop tests were repetitively executed 30 times at a room temperature by dropping them from a height position of 1.2 m to a plastic tile floor. However, no damage was found in any of the vessels.

EXAMPLE 2

Monomer compositions of 100 weight parts comprising acrylonitrile of 80 weight parts, methyl acrylate of 5 weight parts, and styrene of 15 weight parts were polymerized under the existence of a butadiene-acrylonitrile rubber-like copolymer (butadiene of 70 weight %) of 8 weight parts, so that a high-nitryl resin (content ratio of acrylonitrile by the nitrogen analysis was 73 weight %) was obtained.

A vessel was molded in a manner similar to the vessel of Example 1 except that such a high-nitryl resin was used for the inner layer of the vessel main body and Juracon M140 (made by Polyplastics Co., Ltd.) as polyacetal was used for the outer layer of the vessel main body. A content was filled into the vessel. The vessel was sealed and tested similarly to those in the Example 1.

As the results of the tests, no deformation and no damage of the vessels were found.

COMPARATIVE EXAMPLE A

Vessels of the shape similar to that in the Example 1 were molded except that only the high-nitrile resin layer was used. Tests similar to those in the Example 1 were performed.

As the results of the tests, although no content leak was observed, a clear deformation was found out in all of the ten vessels.

On the other hand, according to the drop test, damage was found at the 20th to 28th tests in three of the ten vessels.

EXAMPLE 3

A mixture comprising acrylonitrile of 65 weight parts, styrene of 20 weight parts, and methyl methacrylate of 15 weight parts was polymerized under the existence of a butadiene-acrylonitrile rubber-like copolymer (butadiene of 62 weight %) of 10 weight parts, so that a high-nitryl resin was obtained.

A vessel for aerosol was formed in a manner similar to the Example 1 except that the above high-nitryl resin was used. Tests similar to those in the Example 1 were executed.

As the results of the tests, no abnormality was found in any of the ten vessels similarly to those of Example 1.

EXAMPLE 4

Ethanol and an spray agent were sealed into the same vessels as those used in the Examples 1, 2, and 3 in a manner such that an inner pressure is set to about 5 $kg/cm^3$. This pressure is fairly higher than that of the ordinary aerosol.

Twenty vessels were manufactured with respect to each of the Examples 1 to 3. Each ten vessels were held at 55° C. and 60° C. for one week respectively After that, the vessels were disassembled and the states of the inner surfaces were examined.

With respect to the same vessels as those in the Example 1 and 2, no abnormality was found at both of the test temperatures.

However, with regard to the same vessels as those used in the Example 3, although no abnormality was found at a test temperature of 55° C., in the case of 60° C., small cracks were found in the ultrasonic melt bonded portions in six of the ten samples.

Sheets each having a thickness of 1 mm were manufactured using the above mentioned resins and critical strain to ethanol were measured by the Bergen's ¼ ellipse law. Thus, they were 0.68%, 0.75%, and 0.57%, respectively.

The above three-kinds of high-nitryl resins were respectively dissolved within a mixture solvent in which dimethylformamide and acetonitrile were mixed at a ratio of 1:1, thereby separating into a graft portion which is insoluble to the solvent and a matrix portion which is soluble to the solvent. Contents of acrylonitrile in the resins were examined.

In the resins of the Examples 1 to 3, acrylonitrile contents in the graft resins were 65 weight %, 76 weight %, and 78 weight % respectively and the acrylonitrile contents in the matrix resin were 73 weight %, 78 weight %, and 58 weight %, respectively.

EXAMPLE 5

Monomer compositions of 100 weight parts comprising acrylonitrile of 75 weight parts and methyl acrylate of 25 weight parts were polymerized under the existence of a butadieneacrylonitrile rubber-like copolymer (butadience of 70 weight %) of 10 weight parts, so that a high-nitryl resin (content ratio of acrylonitrile by a nitrogen analysis is set to 70 weight %) was obtained.

By use of the above high-nitryl resin and Panlight L-1225L (made by Teizin-Kasei Co. Ltd.,) as a polycarbonate, a vessel main body whose inner layer is made of the high-nitryl resin and whose outer later is made of polycarbonate was obtained by an injection molding apparatus for molding a double-layer, said apparatus being made by a machine of Nissei Resin Industries, Ltd.

The vessel obtained, in the central portion of the vessel, a width was about 3.5 cm, a thickness was about 3 cm, a cross section was of a rectangular, shape, a height was about 10 cm, and an inner volume was about 75 cc. On the other hand, a thickness of the outer layer was set to about 1.2 mm and a thickness of the inner layer was set to about 1 mm.

On the other hand, a cap member was obtained by injection molding by using the above high-nitryl resin.

A mixture in which the water and ethanol had been mixed by each 50 weight % was poured into the vessel main body. The cap member to which the parts of the spray apparatus had been assembled was melted and bonded and sealed to the vessel main body by an ultrasonic welding while maintaining an inner pressure of 2.5 $kg/cm^2$ with LPG.

Ten vessels were prepared as mentioned above and left at 550° C. which is the same as the test temperature for a gas lighter made of organic resins, for one month and the presence or absence of deformation was examined. However, the maximum deformation was less than 0.5 mm at the middle part of vessel body in all of the vessels.

After said test, all the vessels were cut and the status of the inner surface was examined. Any abnormality such as a crack was not found.

On the other hand, ten other vessels were also similarly manufactured. With respect to those ten vessels, the drop tests were repetitively executed 30 times at a room temperature by dropping them from a height position of 1.2 m to the plastics tile floor. However, no damage was found in any of the vessels.

INDUSTRIAL APPLICABILITY

Vessels for aerosol of the present invention have excellent chemical resistance, gas barrier property, and the like and can be preferably used as vessels for aerosol because the vessel main body has a double-layer structure and the inner layer is made of a high-nitryl resin. On the other hand, the vessels for aerosol of the invention have excellent heat resistance, shock resistance, and the like because the outer layer is made of a synthetic resin having excellent heat resistance, shock resistance, and the like. Further, there is no need to provide a partition wall in the vessels in order to maintain the pressure resistance, thus the inner volume is not reduced.

What is claimed is:

1. A vessel for aerosol comprising:

a vessel main body made of a synthetic resin; and a spray valve assembly made of a synthetic resin, said spray valve assembly being melt-bonded to an opening portion of the vessel main body and being airtightly integrated therewith, wherein the vessel main body has a double-layer structure comprising an inner layer and an outer layer, and wherein said inner layer of the vessel main body is made of a high-nitrile resin and, at least, a housing of the spray valve assembly is made of a high-nitrile resin.

2. A vessel according to claim 1, wherein a vessel main body has a cylindrical shape.

3. A vessel according to claim 1, wherein a vessel main body has a rectangular pipe shape.

4. A vessel according to claim 1, wherein a vessel main body has an elliptical pipe shape.

* * * * *